US007494269B2

(12) United States Patent
Ryter

(10) Patent No.: US 7,494,269 B2
(45) Date of Patent: Feb. 24, 2009

(54) TIMEPIECE MOVEMENT

(75) Inventor: Laurent Ryter, Saint-Blaise (CH)

(73) Assignee: Montres Corum Sarl, La Chaux-De-Fonds (CH)

( * ) Notice: Subject to any disclaimer, the term of this patent is extended or adjusted under 35 U.S.C. 154(b) by 39 days.

(21) Appl. No.: 11/393,948

(22) Filed: Mar. 31, 2006

(65) Prior Publication Data

US 2006/0233054 A1 Oct. 19, 2006

(30) Foreign Application Priority Data

Mar. 31, 2005 (EP) ..... 05102561

(51) Int. Cl.
*G04B 27/02* (2006.01)

(52) U.S. Cl. ..... 368/190

(58) Field of Classification Search ..... 368/190
See application file for complete search history.

(56) References Cited

U.S. PATENT DOCUMENTS

| | | | | |
|---|---|---|---|---|
| 1,481,022 | A | 1/1924 | Mathez | |
| 6,422,740 | B1 * | 7/2002 | Leuenberger | 368/319 |
| 6,773,157 | B1 * | 8/2004 | Grau | 368/308 |

FOREIGN PATENT DOCUMENTS

| | | | |
|---|---|---|---|
| CH | 100 993 | A | 9/1923 |
| CH | 129 340 | A | 12/1928 |
| CH | 623 192 | G | 5/1981 |

OTHER PUBLICATIONS

Théorie d'horologerie, Charles-André Reymondin et al., Fédération des Ecoles Techniques, pp. 36 and 37.

* cited by examiner

*Primary Examiner*—Renee S Luebke
*Assistant Examiner*—Jason Collins
(74) *Attorney, Agent, or Firm*—Finnegan, Henderson, Farabow, Garrett, & Dunner

(57) ABSTRACT

A timepiece movement is disclosed in which a hand-setting stem is oriented in the longitudinal direction of the movement and that includes a relatively short portion inside the movement. A pull-out piece may be mounted pivotably on the frame of the movement and carry a pivoting member, interacting with the frame, and also a linking member designed to interact with the stem to limit the translational movement of the stem. The pivoting member, preferably produced in the form of a pull-out screw, may include first and second pivots arranged on either side of the pull-out piece and engaged in the frame. Preferably, the stem may be engaged, permanently catching, with a crown pinion to form an assembly that may also include first and second pivots arranged on either side of the crown pinion and engaged in the frame.

20 Claims, 5 Drawing Sheets

TIMEPIECE MOVEMENT

TECHNICAL FIELD

The present disclosure relates to timepiece movements and parts thereof. More particularly, the present disclosure relates to component parts of a hand-setting mechanism.

BACKGROUND INFORMATION

In movements that are used in watches, and more particularly, in wrist watches, hand setting may be achieved with a hand-setting stem. This stem may generally be held in place on the movement's frame in a recess in a bottom plate by a pull-out piece that also makes provision for the displacement of other component parts of the mechanism. This arrangement may permit hand setting of the watch when the stem is in the pulled-out position.

In order for these functions to take place reliably, it may be necessary for the stem to be properly guided in the movement's frame, and for the pull-out piece to be well seated. This provides satisfactory holding of the stem by the pull-out piece.

In certain types of timepiece movements, such as the movement described in Swiss Patent No. CH 623 192, the solution described above may not be applied, owing to constructional constraints that might prevent satisfactory guiding of the stem and adequate seating of a pull-out piece. This movement may be of baguette form, having three narrow bridges in the form of small bars that are superposed and assembled with screws arranged through their ends. Space may be lacking, here, to make provision for the above-mentioned functions. Therefore, this movement may be equipped with a hand-setting mechanism in which a hand-setting stem is arranged in the bottom of a case, such that the axis of the stem is parallel to that of watch hands. This solution may require removal of the timepiece from the arm of a wearer in order for the timepiece to be wound and for the hands to be set.

SUMMARY OF THE INVENTION

Embodiments of the present invention are directed towards solving one or more of the problems set forth above. Such embodiments include a timepiece movement that is compact at least in one direction other than its thickness, and that includes a hand-setting crown that is accessible when the corresponding timepiece is worn on the wrist.

To that end, embodiments of the present invention include a movement, preferably of the baguette type, in which a hand-setting stem is oriented in the longitudinal direction of the movement and has a relatively short portion inside the movement. Thus, when the movement is mounted in a watch case, the hand-setting crown is arranged on a side of the case and is consequently accessible while the watch is being worn on the wrist.

A supplementary object of the present invention is to guarantee good stability of the hand-setting mechanism elements despite the small size of frame elements, such as, for example, a bottom plate or bridges.

In particular, it may be important to achieve a high level of precision in movements of moving parts of the hand-setting mechanism, and also in positioning of the parts that guide or actuate these moving parts, as is the case of the hand-setting stem and its pull-out piece.

In accordance with a conventional embodiment, the pull-out piece may include a plate resting principally on the bottom plate, on the dial side, held in place by a pivoting member, such as a pull-out-piece screw arranged through the bottom plate with its head being located on the bridge side. The shank of the screw may bear a screw thread that interacts with a tapped hole in the pull-out piece plate, with the screw defining a pivoting axis of the pull-out piece. A first end of the pull-out piece may include a stud engaged in a groove of the winding stem, allowing the latter to be held in place in the movement. The second end of the pull-out piece may act on a rocker that controls the displacement of a clutch wheel.

In its pushed-in position, the winding stem or hand-setting stem may allow a mainspring to be wound with a rotary movement. For example, when the winding stem is pulled out, it may entrain the first end of the pull-out piece, which pivots on the pull-out-piece screw and acts on the rocker, displacing the clutch wheel. The stem can then be rotated in order to set the hands of the movement.

However, this conventional structure may be ill-suited for holding the component parts of the hand-setting mechanism, particularly when the bottom plate is small and offers only a small surface area for supporting the hand-setting stem or pull-out piece.

Thus, embodiments of the present invention include a timepiece movement of the type described above, including first and second support elements that are distinct from the bottom plate and are secured to the frame, and between which there is a crown pinion integral in rotation with the hand-setting stem. The first and second support elements may define, respectively, first and second bearings for the assembly formed by the crown pinion and the hand-setting stem.

According to a preferred exemplary embodiment, the baguette movement may be arranged such that it presents a frame having a median portion delimited by two end portions intended to be connected to the watch case, the median portion having a length oriented on a six o'clock and midday axis and being at least three times as large as its width. Furthermore, the hand-setting crown may be arranged at one end of the hand-setting stem located at one of six o'clock or midday.

By virtue of these characteristics, the positioning of the hand-setting stem may be improved, and in particular, may guarantee the reliability of the changeover between the winding function and the hand-setting function when the hand-setting stem is displaced in its axial direction.

In a preferred embodiment, the present invention also makes provision for supplementary components enabling the stability of the pull-out piece to be improved during movements of the hand-setting stem.

BRIEF DESCRIPTION OF THE DRAWINGS

Other characteristics and advantages of the present invention will become more clearly apparent on reading the following detailed description, given with reference to the appended drawings that are provided for exemplary purposes, and in which.

DETAILED DESCRIPTION

Figure 1:
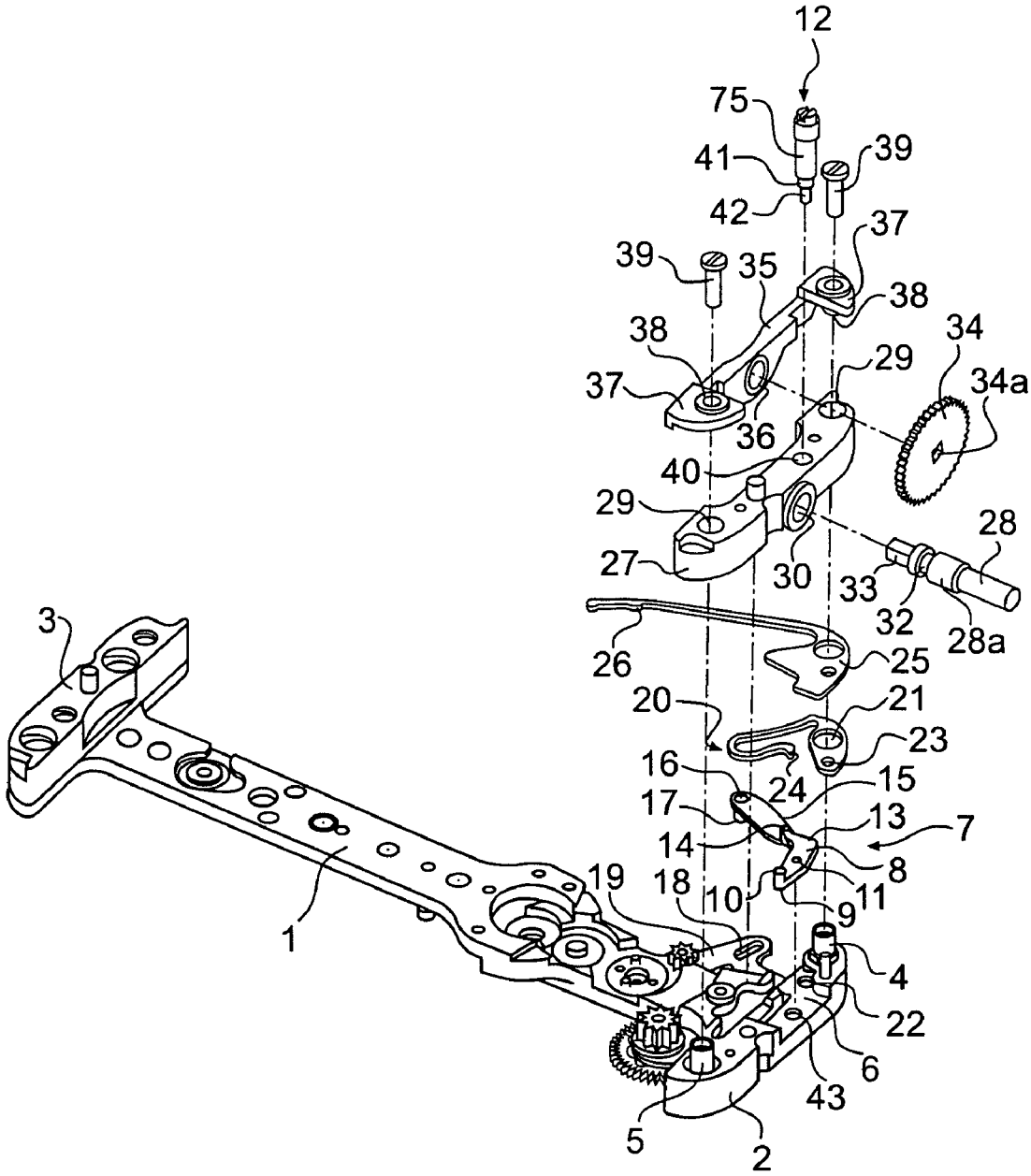
FIG. 1 shows an exploded view of a portion of an exemplary timepiece movement, according to an embodiment of the present invention.

FIG. 1 shows, in an exploded view, a portion of an exemplary timepiece movement provided with a hand-setting mechanism according to an embodiment of the invention. This movement may include a bottom plate 1 having an elongate general form in which a median portion is delimited by first and second transverse end portions 2 and 3, the width of which corresponds to the width of the assembled movement.

First end portion 2 may include two posts 4, 5 for assembling component parts of the hand-setting mechanism of the movement.

In particular, first end portion 2 may include a recess 6, between the two posts 4 and 5, in which a winding pull-out piece 7 is arranged.

Pull-out piece 7 may include a plate formed from a first portion 8 and from a second portion 15. First portion 8 may carry, at a first free end 9, a first hand-setting stem stud 10. Pull-out piece 7 may also include a tapped hole 11 designed to interact with a threaded portion of a pull-out piece screw 12, and an elbow 13 located at a distance from first stud 10, followed by a curved tongue 14. Second pull-out piece portion 15, which may be thinner than the first portion 8, may extend in the prolongation of tongue 14 as far as a second free end 16 that carries a second stud 17.

When pull-out piece 7 is in place on bottom plate 1, second stud 17 may be engaged in a groove 18 of a rocker 19 located on the dial side of bottom plate 1, as described in greater detail in connection with FIG. 3.

A pull-out piece jumper 20 may be engaged on post 4 via a first principal hole 21. A supplementary post 22 of bottom plate 1 may be provided in order to interact with a second hole 23 of pull-out piece jumper 20. Pull-out piece jumper 20 may have a curved, elongate form ending in a nose 24 designed to interact with curved tongue 14 of the pull-out piece, in order to position the latter.

Figure 3:
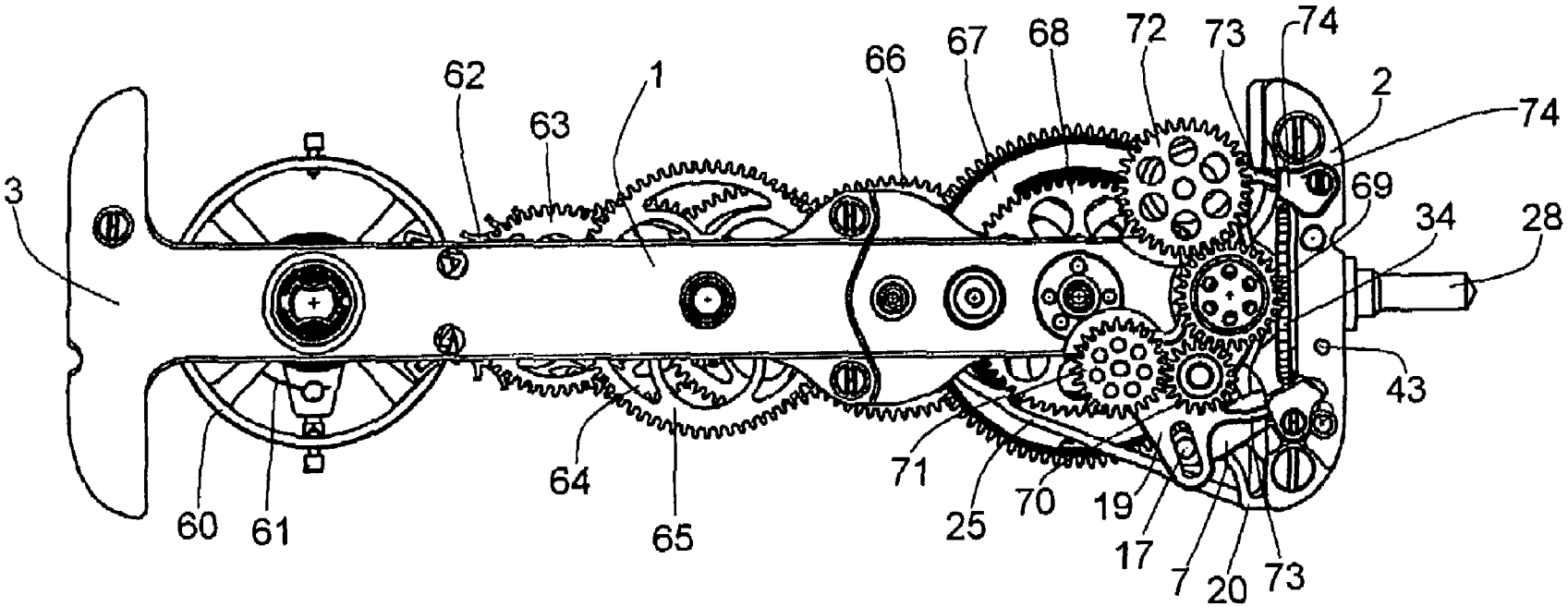
FIG. 3 shows another plan view of the timepiece movement of FIG. 1.

A spring 25 may also be engaged on posts 4 and 22 in order to act, through a nose 26, with a barrel pawl 68 (visible in FIG. 3).

An intermediate bridge 27 with two holes 29 configured to interact with posts 4 and 5, may be mounted on bottom plate 1. An assembly of this type makes it possible to achieve precise positioning and great stability of intermediate bridge 27 with reference to bottom plate 1. Intermediate bridge 27 may also include a hole 30, having a generally cylindrical shape, emerging in its face opposite the bottom plate (visible in FIG. 4*a*). Hole 30 may have an axis parallel to the longitudinal direction of the movement. Hole 30 may be designed to accommodate and to position winding or hand-setting stem 28, with the interposition of a tube 31, split over its entire length, having a diameter slightly smaller than the diameter of hole 30. Stem 28 may include a cylindrical portion 28*a*, interacting with tube 31, that allows its pivoting and translational movement with reference to bridge 27. Stem 28 may include a groove 32 in which stud 10 of pull-out piece 7 is engaged when the winding mechanism is assembled. A crown 89 may be coupled to stem 28 (visible in FIG. 5).

A square 33 may be arranged after cylindrical portion 28*a*, and may extend as far as the end of stem 28 located in the movement. A crown pinion 34, that may include a hole 34*a*, may be configured to interact with square 33 of winding stem 28. Crown pinion 34 may be arranged adjacent to intermediate bridge 27, and may be mounted on winding stem 28. It is contemplated that square 33 and hole 34*a* may be arranged such that a rotation of stem 28 turns pinion 34, while allowing a translational movement of one relative to the other.

A supplementary element 35 may be provided adjacent to intermediate bridge 27, and may be configured to hold stem 28 and crown pinion 34 in their respective positions. Supplementary element 35 may include a hole 36 inside which square 33 engages. Crown pinion 34 may be held axially in the space between bridge 27 and element 35. The latter may also include lugs 37 designed to partially cover intermediate bridge 27. Lugs 37 may include tubes 38 extending in the direction of bottom plate 1 in order to engage in holes 29 of intermediate bridge 27, and to surround posts 4 and 5. Tubes 38 make it possible to precisely position supplementary element 35 relative to intermediate bridge 27, and relative to bottom plate 1, using posts 4 and 5.

Two screws 39 may be inserted in tubes 38 of supplementary element 35, in order to interact with tapped posts 4 and 5 and to assemble together the elements just described.

By virtue of this construction, hand-setting stem 28 may be efficiently held in the movement, even if its portion that is arranged in the movement is relatively short relative to known constructions.

Pull-out piece screw 12 may be housed inside a hole 40 made in intermediate bridge 27. Pull-out piece screw 12 may define the axis of rotation of pull-out piece 7, and may be provided with a screw thread 41, configured to interact with hole 11 of pull-out piece 7 in a known manner.

Pull-out piece screw 12 may also include a free end 42 extending beyond screw thread 41, configured to be inserted inside a hole 43 made in bottom plate 1, as will be described in greater detail in connection with FIGS. 4*a* and 4*b*.

Figure 5:
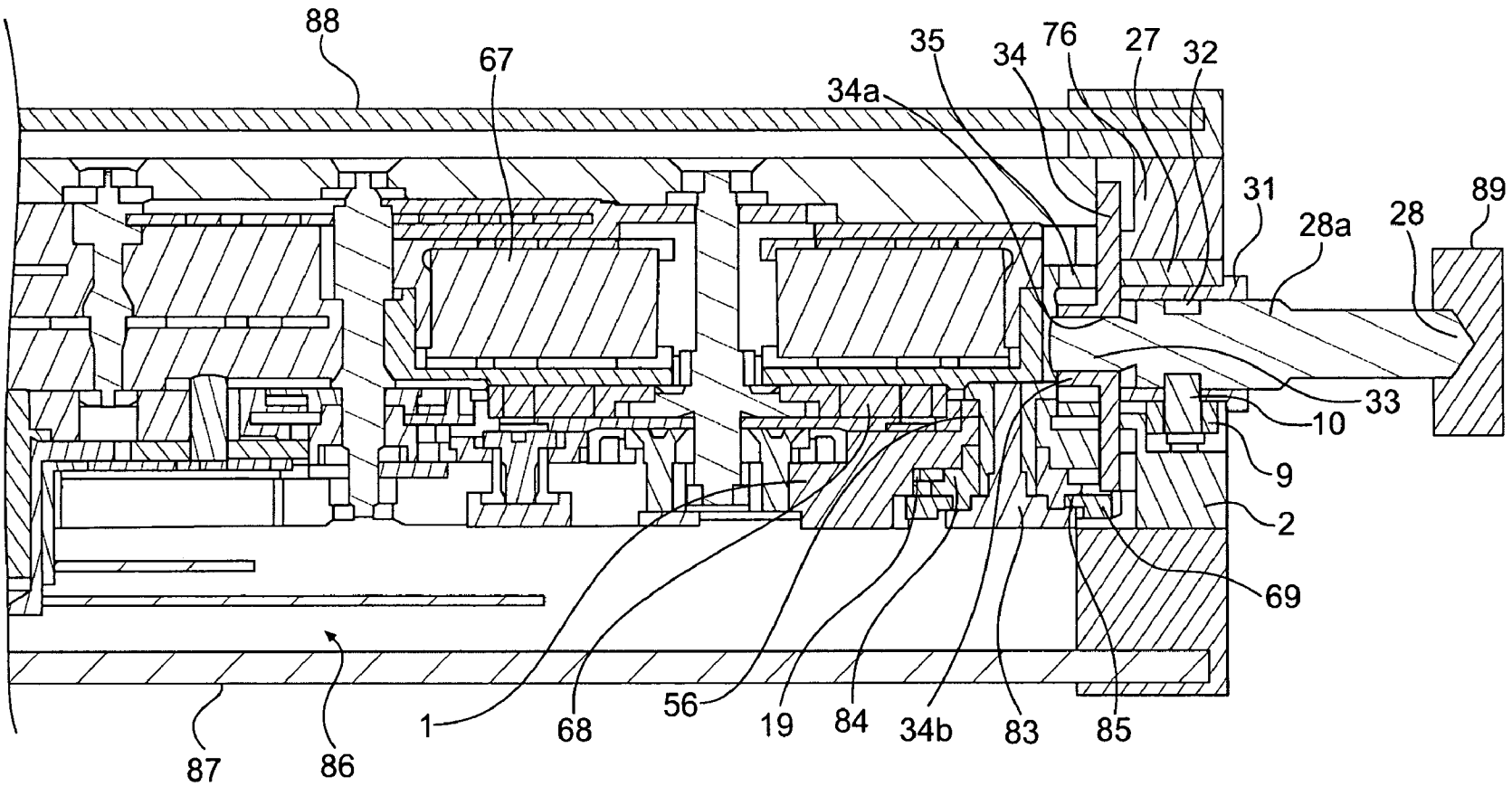
FIG. 5 shows a third cross-sectional view of constructional details of the timepiece movement of FIG. 1, taken along the line 5 of FIG. 2.

Furthermore, between its two ends 2 and 3, bottom plate 1 may include a plurality of locations, holes, and bearing surfaces, configured to carry conventional watch-movement components. Such components may include, for example, a time display mechanism 86 and a glass 87. as shown in FIG. 5. A case 88 may also be provided on a side of the timepiece movement opposite glass 87. These will not be described in detail, as they do not directly concern the core subject of the present disclosure.

Figure 2:
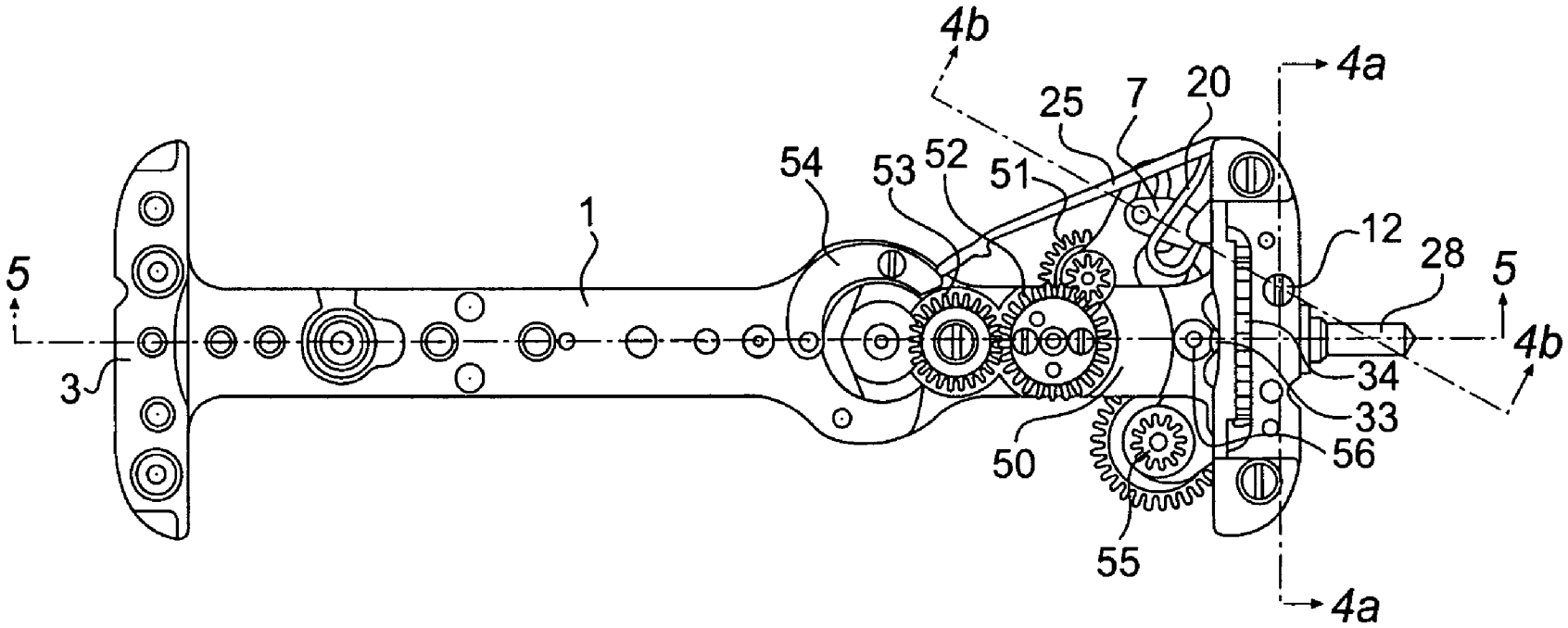
FIG. 2 shows a plan view of the timepiece movement of FIG. 1.

FIG. 2 shows a plan view of the portion of the movement shown in FIG. 1, when its component parts have been assembled together.

It will be seen that bottom plate 1 may include a recess 50, to accommodate a barrel of the movement, provided close to its first end 2.

Rocker 19 may carry a first setting wheel 51 for setting watch hands (not shown), catching with a second setting wheel 52. Second setting wheel 52 may catch with a third setting wheel 53. Second and third setting wheels 52, 53 may be arranged in a bottom portion of countersink 50.

A small plate 54 for positioning spring 25 is also shown, and may enable spring 25 to be held in the direction of the thickness of the movement.

It can also be seen in FIG. 2 that rocker 19 may carry a winding setting wheel 55, designed to mesh with barrel pawl 68 (visible in FIG. 3) during mainspring-winding operations.

A tube 56, only one end of which can be seen in FIG. 2, may be arranged through bottom plate 1 in order to define a pivot for rocker 19.

FIG. 3 shows a plan view, on the dial side, of the complete movement according to an embodiment of the present invention.

FIG. 3 illustrates, from second end 3 of bottom plate 1 and in the direction of first end 2, a balance 60, including a balance spring 61, an escape wheel 62, a minute wheel 63, a reduction wheel 64, an hour wheel 65, a center wheel 66, a barrel 67, and barrel pawl 68.

Furthermore, the structure and functioning of rocker 19 are shown more clearly in FIG. 3, with respect to the description of the members arranged on the dial side.

A crown wheel 69, coaxial with tube 56 on which rocker 19 may pivot, may be arranged so as to catch permanently on crown pinion 34. Furthermore, it may permanently mesh with a first hand-setting wheel 70, which entrains a second hand-setting wheel 71. Second intermediate hand-setting wheel 71 may be mounted coaxial with and secured to first setting wheel 51 for setting the hands, the latter being arranged on the bridge side of rocker 19, as previously described.

Crown wheel 69 may also permanently mesh with an intermediate wheel 72 mounted coaxial with and secured to winding setting wheel 55, the latter being located on the bridge side of rocker 19.

Rocker 19 may include two arms 73, located at a distance from its pivoting axis and on either side of the latter, extending as far as first end 2 of bottom plate 1. Each of the free ends (not shown) of arms 73 may be held in a groove (not shown) of bottom plate 1 by small plates 74 to improve the stability and guiding of rocker 19, particularly when it is in either the hand-setting or winding position.

Figure 4B:
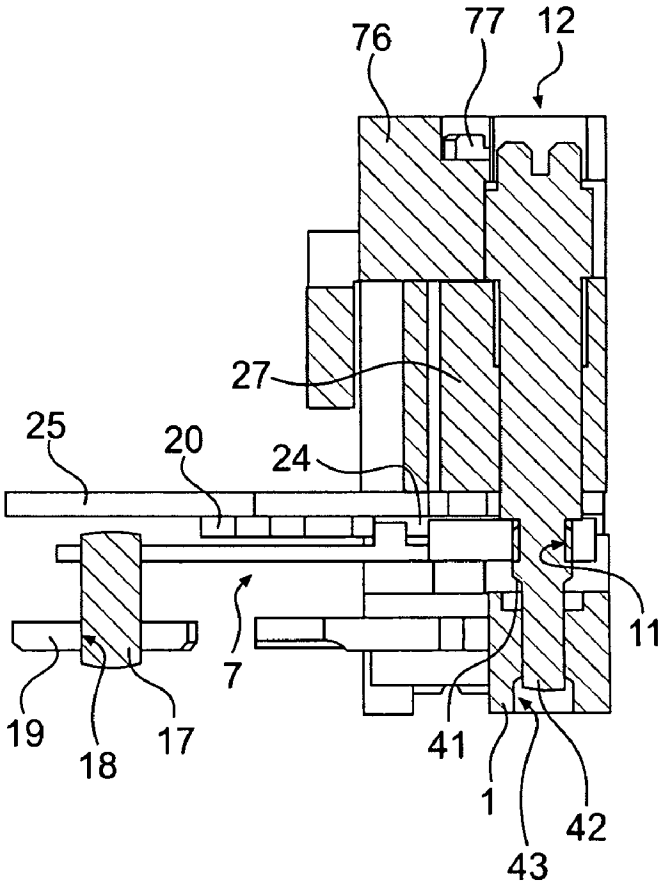
FIG. 4*b* shows a second cross-sectional view of constructional details of the timepiece movement, taken along the line 4*b* of FIG. 2.
Figure 4A:
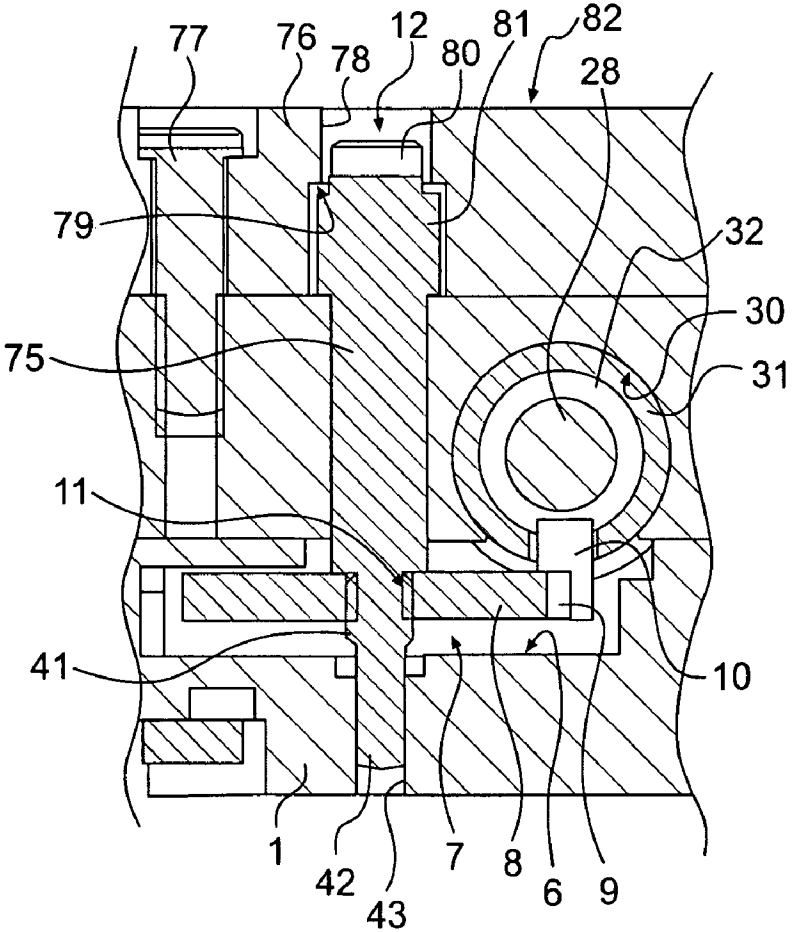
FIG. 4*a* shows a first cross-sectional view of constructional details of the timepiece movement, taken along the line 4*a* of FIG. 2.

FIGS. 4*a* and 4*b*, which show sectional views of constructional details of the movement just described, provide a better understanding of how the pivoting of rocker 19 is controlled, by virtue of the special structure of pull-out piece 7.

FIG. 4*a* shows a view of a cross-section through a plane perpendicular to the median plane of bottom plate 1 containing the line referenced 4*a* in FIG. 2. First portion 8 of pull-out piece 7 is clearly visible in FIG. 4*a*. Pull-out piece screw 12 is shown in its functional position, i.e. when it is inserted in hole 40 of intermediate bridge 27 and then screwed into hole 11 of pull-out piece 7. Pull-out piece screw 12 may be screwed into pull-out piece 7 until pull-out piece 7 abuts against cylindrical part 75 of pull-out piece screw 12 housed in intermediate bridge 27. In this configuration, pull-out piece 7 may be positioned in a direction substantially parallel to the median plane of bottom plate 1, defining a clearance between itself and recess 6 of bottom plate 1. First portion 8 of pull-out piece 7 may therefore be unsupported by bottom plate 1 when pull-out piece 7 is in its functional position. Furthermore, when screwing is complete, stud 10 of pull-out piece 7 may be in position inside groove 32 of winding stem 28. Thus, in a known manner, the pull-out-piece stud 10 may be entrained by the movements of winding stem 28 in its axial direction, which gives rise to the pivoting of pull-out piece 7 on pull-out piece screw 12. As mentioned previously in connection with the description of FIG. 1, pull-out piece screw 12 may include a free end 42 extending beyond screw thread 41 and housed in a hole 43 in bottom plate 1 in order to form a pivot. This particular characteristic of pull-out piece screw 12 makes it possible, as compared with the most common structures of the prior art, to improve the holding thereof and also to improve the stability and positioning of pull-out piece 7 with respect to bottom plate 1.

Such a characteristic is even more advantageous when implemented in a movement of the type described herein. In particular, bottom plate 1, by being compact, does not allow a significant portion of pull-out-piece 7 to be supported, unlike in conventional movements. Thus, the improvement in the stability of pull-out-piece screw 12 compensates for the lesser degree of holding of pull-out piece 7 by bottom plate 1.

As shown in FIG. 4*a*, a bridge 76 may be mounted on intermediate bridge 27, with bridge 76 extending between first and second ends 2 and 3 of bottom plate 1 in a manner similar to that which is described in patent CH 623 192 mentioned above. Bridge 76 may be secured to the intermediate bridge by two screws 77, only one of which can be seen in FIG. 4*a*.

Bridge 76 may include a hole 78, for access to the head of pull-out-piece screw 12, having two successive portions of different diameters, defining between them a shoulder 79 inside hole 78. The head of pull-out-piece screw 12 may include two successive portions, namely a first end portion 80, with a first diameter, and a second portion 81, with a second diameter that is greater than the first diameter and the diameter of shoulder 79. Consequently, when bridge 76 is placed on intermediate bridge 27, pull-out-piece screw 12 cannot be removed from its location. However, the head of pull-out-piece screw 12 can be accessed from upper face 82 of bridge 76, to allow pull-out-piece screw 12 to be unscrewed and winding stem 28 to be released, in a conventional manner, in order for the movement to be removed from the case. During an operation of this type, unscrewing of pull-out-piece screw 12 may give rise to a translational movement of pull-out piece 7 in the direction of bottom plate 1, since screw 12 may remain in its axial, service position, where it is held by bridge 76.

The fact that pull-out piece screw 12 cannot be removed from its location when bridge 76 is in place may make it possible to avoid losing it when removing the movement from the case.

FIG. 4*b* shows a cross-sectional view of pull-out piece 7 in a plane perpendicular to the plane of FIG. 2 and containing the line referenced 4*b* , showing more clearly the lack of support offered by bottom plate 1 to pull-out piece 7 and the interaction of the latter with rocker 19.

Although pull-out piece 7 may rest practically entirely on bottom plate 1, it should be noted that, in FIG. 4*b*, not all of second portion 15 of pull-out piece 7 rests on bottom plate 1 or on any other fixed component of the movement. However, by virtue of the characteristics of an embodiment of the present invention, particularly those characteristics described in connection with FIG. 4*a*, the stability and positioning of pull-out piece 7 may be guaranteed in order to enable it to fulfill its principal function of controlling the pivoting movements of rocker 19. Accordingly, pull-out piece 7 may be linked to groove 18 of rocker 19 via a stud 17.

Generally, and in connection with FIGS. 1-5, it should be understood that depending on the position of winding stem 28, pull-out piece 7 may also adopt two extreme positions, one of winding and the other of setting the hands. The particular form of groove 18 may define stops that correspond to the extreme positions of pull-out piece 7.

When pull-out piece 7 is displaced towards its winding position, its second portion 15 may be distanced from bottom plate 1 through the exertion of a pulling force in this direction on groove 18 of rocker 19. That portion of rocker 19 in which groove 18 is made may thus also be distanced from bottom plate 1. Accordingly, in this position, first setting wheel 51 may also be distanced from bottom plate 1, and may not be catching on second setting wheel 52. Furthermore, the other side of rocker 19 may be close to bottom plate 1, allowing meshing of winding setting wheel 55 with barrel pawl 68.

In this position of winding stem 28 and rocker 19, any rotary movement of winding stem 28 may give rise to a rotation of barrel pawl 68, winding the main spring of barrel 67. More precisely, provision may preferably be made, in a known manner, for a ratchet mechanism (not shown) to be placed between intermediate wheel 72 and setting wheel 55. Thus, barrel pawl 68 may be entrained only during the rotary movements of winding stem 28 in the clockwise direction through the combined effect of the action of spring 25 on barrel pawl 68 and of the ratchet mechanism.

When winding stem 28 is pulled out, it may entrain stud 10 of pull-out piece 7, via groove 32. Pull-out piece 7 may then pivot on pull-out-piece screw 12, its second portion 15 approaching bottom plate 1.

During pivoting of pull-out piece 7, stud 17 may exert a force on groove 18 of rocker 19, giving rise to a pivoting of the latter about tube 56. In this pivoting movement, first setting wheel 51 may move closer to bottom plate 1, while winding setting wheel 55 moves away from it. First setting wheel 51 may engage second setting wheel 52 for setting the hands, while setting wheel 55 may separate from barrel pawl 68.

In this position, the rotary movements of winding stem 28 in one direction or the other may give rise to the rotation of the crown pinion 34, by setting wheels 52 and 53, and thus of hour wheel 65, in order to set the hands of the timepiece in which the movement is employed. Additionally or alternatively, friction, preferably provided in the region of center wheel 66, makes it possible to prevent damage that could be caused to a gear-train drive during hand-setting operations.

FIG. 5 shows an embodiment of the movement according to the present invention in a cross-sectional view through a plane perpendicular to the plane of FIG. 2 and containing the line 5.

The shortness of the portion of hand-setting stem 28 that is located inside the movement is particularly apparent from this view. Such an arrangement may render construction delicate.

According to this embodiment, crown pinion 34 may include a tube 34*b* coaxial with hole 34*a* and oriented in the direction of the inside of the movement. The outside diameter of tube 34*b* may be slightly smaller than the diameter of hole 36 of supplementary element 35 inside which it is inserted. By virtue of this advantageous characteristic, tube 34*b* may help to stabilize crown pinion 34 relative to bottom plate 1.

The internal cross section of tube 34*b* may be identical to the cross section of hole 34*a*, such that the inner shape of tube 34*b* substantially complements that of square 33 of winding stem 28. The respective dimensions of tube 34*b* and of square 33 are such that slight clearance may preferably be provided between them.

Furthermore, it should also be noted that as shown in FIG. 5, tube 56 may include a tapped central hole that interacts with the shank of a bearing surface screw 83 engaged in bottom plate 1 from its dial side.

A post 84 may be arranged around tube 56, interposed between the head of screw 83 and bottom plate 1, with a view to guaranteeing positioning of screw 83 relative to bottom plate 1. The head of screw 83 may be relatively wide relative to its shank, and the portion located between two bearing surfaces may strengthen the rigidity thereof. Furthermore, it should be observed that post 84 may include two bearing surfaces between which rocker 19, free in rotation, may be arranged, in order to guarantee holding of the latter in the axial direction.

Moreover, post 84 may include a support surface 85 against which crown wheel 69 may be mounted while being free to turn relative to the axis of tube 56. Axial holding of crown wheel 69 may also be provided by the head of bearing surface screw 83 while its centering is provided by post 84.

From the above description it will be understood that the characteristics of the movement according to embodiments of the present invention make it possible to guarantee satisfactory positioning and proper guiding of certain moving parts fulfilling functions essential to the smooth functioning of the movement, and more particularly, of hand-setting stem 28 and pull-out piece 7, although the dimensions of the movement-support elements may be exceptionally small.

The above description corresponds to embodiments of the invention described for exemplary purposes only. As such, the forms shown and described for the various component parts of the movement are not intended to be limiting.

By way of example, a person skilled in the art may implement alternatives to arms 73 in order to guarantee good stability of rocker 19, without departing from the scope of the present invention.

Furthermore, screw 12 could be replaced by a rod (not shown) chased into pull-out piece 7 and held axially by bridge 76, while a spring (not shown) bearing against pull-out piece 7 would hold stud 10 engaged in groove 32. Pressure on the rod would then deform the spring and allow stem 28 of pull-out piece 7 to be released.

What is claimed is:

1. A timepiece movement comprising:

a frame comprising a bottom plate;

a time display mechanism;

a hand-setting mechanism comprising a hand-setting stem, movably mounted on the frame and configured to translate along a first axis between at least two axial positions and to rotate about the first axis, and capable of being operatively connected to the time display mechanism; and first and second support elements distinct from the bottom plate and secured to the frame, between which there is a crown pinion, the crown pinion including a tube engaged in rotation with the hand-setting stem, the first and second support elements defining respective first and second bearings for an assembly formed by the crown pinion and the hand-setting stem.

2. The timepiece movement of claim 1, wherein the tube is engaged in rotation with a square of the hand-setting stem, the tube being configured to pivot in the second support element, the hand-setting stem having a bead pivoting in the first support element.

3. The timepiece movement of claim 2, further comprising a pull-out piece mounted pivotably on the frame, the pull-out piece comprising:

a plate that carries a pivoting member interacting with the frame; and a linking member configured to interact with the hand-setting stem to limit the translational movement of the hand-setting stem and to allow a pivoting of the pull-out piece when the hand-setting stem is displaced in translation;

the pivoting member comprising first and second pivots arranged on either side of the plate and engaged in the frame.

4. The timepiece movement of claim 3, wherein:

the pivoting member is a pull-out screw comprising a first cylindrical portion, arranged on a first side of the pull-out piece plate, forming the first pivot; and the pull-out screw further comprises a threaded portion screwed into the plate, followed by a cylindrical second portion arranged on a second side of the plate forming the second pivot.

5. The timepiece movement of claim 4, further comprising a winding mechanism for winding a barrel mainspring and wherein the hand-setting mechanism comprises a rocker mounted pivotably between first and second positions on the frame, the rocker being controlled by the pull-out piece to selectively actuate one of the hand-setting mechanism and the winding mechanism.

6. The timepiece movement of claim 3, further comprising a winding mechanism for winding a barrel mainspring and wherein the hand-setting mechanism comprises a rocker mounted pivotably between first and second positions on the frame, the rocker being controlled by the pull-out piece to selectively actuate one of the hand-setting mechanism and the winding mechanism.

7. The timepiece movement of claim 6, wherein the linking member is a first stud arranged near a first end of the pull-out piece, and wherein the pull-out piece comprises a second stud arranged proximate a second end of the pull-out piece while being engaged in a groove of the rocker to control the rocker.

8. The timepiece movement of claim 6, wherein the rocker is secured to the frame, in its pivot axis direction, by at least one arm partially engaged in a region of the frame while being free to move in directions perpendicular to the axis of pivoting only.

9. The timepiece movement of claim 1, further comprising a pull-out piece mounted pivotably on the frame, the pull-out piece comprising:

a plate that carries a pivoting member interacting with the frame; and a linking member configured to interact with the hand-setting stem to limit the translational movement of the hand-setting stem and to allow a pivoting of the pull-out piece when the hand-setting stem is displaced in translation;

the pivoting member comprising first and second pivots arranged on either side of the plate and engaged in the frame.

10. The timepiece movement of claim 9, wherein:

the pivoting member is a pull-out screw comprising a first cylindrical portion, arranged on a first side of the pull-out piece plate, forming the first pivot; and the pull-out screw further comprises a threaded portion screwed into the plate, followed by a cylindrical second portion arranged on a second side of the plate forming the second pivot.

11. The timepiece movement of claim 10, further comprising a winding mechanism for winding a barrel mainspring and wherein the hand-setting mechanism comprises a rocker mounted pivotably between first and second positions on the frame, the rocker being controlled by the pull-out piece to selectively actuate one of the hand-setting mechanism and the winding mechanism.

12. The timepiece movement of claim 9, further comprising a winding mechanism for winding a barrel mainspring and the hand-setting mechanism comprises a rocker mounted pivotably between first and second positions on the frame, the rocker being controlled by the pull-out piece to selectively actuate one of the hand-setting mechanism and the winding mechanism.

13. The timepiece movement of claim 12, wherein the rocker is secured to the frame, in its pivot axis direction, by at least one arm partially engaged in a region of the frame while being free to move in directions perpendicular to the axis of pivoting only.

14. The timepiece movement of claim 12, wherein the linking member is a first stud arranged near a first end of the pull-out piece, and wherein the pull-out piece comprises a second stud arranged proximate a second end of the pull-out piece while being engaged in a groove of the rocker to control the rocker.

15. The timepiece movement of claim 14, wherein the first stud is arranged on a first side of the plate while the second stud is arranged on a second side of the plate.

16. A timepiece part including a case closed by a glass and in which is housed a movement comprising:

a frame comprising a bottom plate;

a time display mechanism;

a hand-setting mechanism comprising a hand-setting stem, movably mounted on the frame and configured to translate along a first axis between at least two axial positions and to rotate about the axis, capable of being operatively connected to the time display mechanism;

first and second support elements distinct from the bottom plate and secured to the frame, between which there is a crown pinion integral in rotation with the hand-setting stem, the first and second support elements defining respective first and second pivots for an assembly formed by the crown pinion and the hand-setting stem, at least one of the first and second support elements receiving an annular member that receives a portion of the hand-setting stem;

the movement being arranged so the frame has a median portion, supporting a finishing-works assembly and a time display, delimited by two end portions connected to the case, the median portion having a length oriented on a six o'clock and midday axis and being at least three times as large as its width; and a hand-setting crown being arranged at one end of the hand-setting stem located at one of six o'clock or midday.

17. The timepiece part of claim 16, wherein the annular member includes a tube on the crown pinion, the tube being engaged in rotation with a square of the hand-setting stem, and being configured to pivot in the second support element, and the hand-setting stem having a bead pivoting in the first support element.

18. The timepiece part of claim 16, wherein the movement further comprises a pull-out piece mounted pivotably on the frame, the pull-out piece comprising:

a plate that carries a pivoting member interacting with the frame; and a linking member configured to interact with the hand-setting stem to limit the translational movement of the hand-setting stem, and to allow pivoting of the pull-out piece when the hand-setting stem is displaced in translation;

wherein the pivoting member comprises first and second pivots arranged on either side of the plate and engaged in the frame.

19. The timepiece part of claim 18, wherein the movement further comprises a winding mechanism for winding a barrel mainspring and wherein the hand-setting mechanism comprises a rocker mounted pivotably between first and second positions on the frame, and the rocker being controlled by the pull-out piece to selectively actuate one of the hand-setting mechanism and the winding mechanism.

20. A timepiece movement comprising:

a frame comprising a bottom plate;

a time display mechanism;

a hand-setting mechanism comprising a hand-setting stem, movably mounted on the frame and configured to translate along a first axis between at least two axial positions and to rotate about the first axis, and capable of being operatively connected to the time display mechanism; and first and second support elements distinct from the bottom plate and secured to the frame, between which there is a crown pinion integral in rotation with the hand-setting stem, the first and second support elements defining respective first and second bearings for an assembly formed by the crown pinion and the hand-setting stem, at least one of the first and second support elements receiving an annular member that receives a portion of the hand-setting stem.

* * * * *